United States Patent [19]

Dickey et al.

[11] Patent Number: 4,619,483

[45] Date of Patent: Oct. 28, 1986

[54] PHYSICALLY HANDICAPPED SHOULDER SUPPORT FOR ATTACHMENT TO A CHAIR BACK

[75] Inventors: Donna J. Dickey; Sebastian Dobler, both of Kingston; Natalie Horejda, Regina, all of Canada

[73] Assignee: Her Majesty the Queen in right of Canada, as represented by the Minister of Health, Toronto, Canada

[21] Appl. No.: 656,365

[22] Filed: Oct. 1, 1984

[51] Int. Cl.[4] ..... A47C 1/10

[52] U.S. Cl. ..... 297/397; 297/410; 297/394

[58] Field of Search ..... 297/397, 464, 410, 440, 297/394

[56] References Cited

U.S. PATENT DOCUMENTS

| | | | |
|---|---|---|---|
| 3,226,159 | 12/1965 | Binding | 297/410 X |
| 3,307,874 | 3/1967 | Wilson | 297/410 |
| 3,608,964 | 9/1971 | Earl | 297/397 |
| 3,761,126 | 9/1973 | Mucholland | 297/467 |
| 3,922,030 | 11/1975 | Stedman | 297/464 X |
| 3,938,859 | 2/1976 | Henderson et al. | 297/353 X |
| 4,073,537 | 2/1978 | Hammersburg | 297/464 |
| 4,130,318 | 12/1978 | Hemmen et al. | 297/464 X |
| 4,383,713 | 5/1983 | Roston | 297/464 X |
| 4,402,548 | 9/1983 | Mason | 297/464 |

FOREIGN PATENT DOCUMENTS

| | | | |
|---|---|---|---|
| 1399285 | 7/1975 | United Kingdom | 297/464 |

*Primary Examiner*—Francis K. Zugel
*Assistant Examiner*—José V. Chen
*Attorney, Agent, or Firm*—Sim & McBurney

[57] ABSTRACT

An adaptation for a chair for the physically handicapped comprises a special shoulder support arrangement which is connected to the back of the chair. A headrest is provided on the shoulder support and overlaps a portion of the back. A recess is defined below the headrest and along the shoulder support to receive and support a shoulder of a person sitting on the chair supporting their lean to that side. The headrest is mounted on the shoulder support in a manner to provide for vertical height adjustment of the headrest relative to the seat to accommodate varying shoulder heights of persons using the chair. This type of adaptation encourages the physically handicapped to use their own muscles to sit up in the chair. The attachment is particularly suitable to people who are suffering from deteriorating muscular conditions as well as victims of organic brain syndromes such as Alzheimer's disease.

11 Claims, 9 Drawing Figures

PHYSICALLY HANDICAPPED SHOULDER SUPPORT FOR ATTACHMENT TO A CHAIR BACK

FIELD OF THE INVENTION

This invention relates to support arrangements for use in association with chairs to support and encourage improved posture of the physically handicapped.

BACKGROUND OF THE INVENTION

People who suffer from lack of muscular control due to some genetic defect, disease related problem or physical injury, have great difficulty sitting in chairs. Although the people may be mentally alert, they are normally confined to beds which does not advance their social outlook, particularly when they may have to cope with the physical disability for many years. In order to encourage social behavior and a feeling of well being in the physically handicapped person, attempts have been made to strap or tie the individuals into a chair to keep them in an upright position. If not so tied, they tend to lean to either side and/or their arms drape out over the chair. The difficulty with strapping people into a chair is that it does not encourage them to use their muscles in any way to maintain some degree of muscle tone. Thus the muscles become more and more flaccid or weak and eventually deteriorate.

An example for tieing a person into a chair is disclosed in U.S. Pat. No. 3,992,057. The chair has crotch and arm supports and the straps are passed around the person's chest to hold them erect in the chair. Other attempts have been made to support a person's torso in a chair, such as disclosed in U.S. Pat. No. 3,704,910. An adjustable cushion torso engaging member is adapted to be mounted on a wheelchair or the like for purposes of supporting the person's torso to enable the person to sit upright. The torso support can be adjusted to the front side and back side of the torso and vary the elevation of the support.

It is important to encourage correct posture of the physically handicapped so that they use their own muscles as best they can to support themselves in the chair. As noted, strapping the person in the chair does not improve posture because the unsupported portions of the body may tend to lean or slouch.

The support system, according to this invention, for securement to a chair back encourages the patient to use his or her muscles in sitting upright in the chair.

SUMMARY OF THE INVENTION

According to an aspect of the invention, a chair comprises a seat, a back and opposing side arms. A shoulder support is connected to a side of the back and extends outwardly of the back in the general direction of a corresponding side arm. A head rest is mounted on the shoulder support and overlaps a portion of the back. A recessed area is defined below the headrest and along the shoulder support to receive and support a shoulder of a person sitting on the chair. Means is provided for mounting the headrest on the shoulder support to provide for vertical height adjustment of the headrest relative to the seat to accommodate varying shoulder heights of persons using the chair.

According to another aspect of the invention, a hip bolster is provided along the side arm and the seat to space a person's hip from the side arm and thereby define the recessed area between the headrest and the hip bolster to receive a shoulder of a person using the chair and in turn allow positioning of the person's arm within the recessed area. This avoids the person's arm draping over the side of the chair which, if continued for any length of time, can result in swelling and considerable discomfort.

According to another aspect of the invention, a support arrangement for connection to a chair in supporting the physically handicapped who tend to lean to either or both sides of the chair is provided. The support arrangement comprises a padded shoulder support of a width greater than the width of a person's shoulder and of a length to extend along the majority of the height of the back of the chair to which the support arrangement is to be connected. A padded headrest is provided and mounted on the shoulder support by mounting means. The mounting means provides for adjustability of the headrest to give various vertical height positions of the headrest along the shoulder support. The shoulder support has means for enabling connection of the support arrangement to a back of a chair.

BRIEF DESCRIPTION OF THE DRAWINGS

Preferred embodiments of the invention are shown in the drawings, wherein.

DETAILED DESCRIPTION OF THE PREFERRED EMBODIMENTS

The shoulder support arrangement, according to this invention, meets the needs of people having various forms of physical disabilities thereby eliminating the need for custom made types of supports which can be costly and time consuming. The side support arrangement is non-restrictive to the physical positioning of an individual in the chair and when attached to a chair, provides an aesthetically pleasing, socially acceptable arrangement for supporting the individual in the chair as compared to systems which strap the individual in the chair. The shoulder support arrangement is designed to promote correct posture of the spine and preclude or reduce back deformity. The arrangement also reduces strain on the back and sides and decreases the possibility of skin break down. In preventing side leaning resulting in the person's limbs draping over the chair side, pressure on axiliary nerves is eliminated as well as preventing swelling in the individual's arms in reducing the likelihood of their dangling over the chair side.

Figure 1:
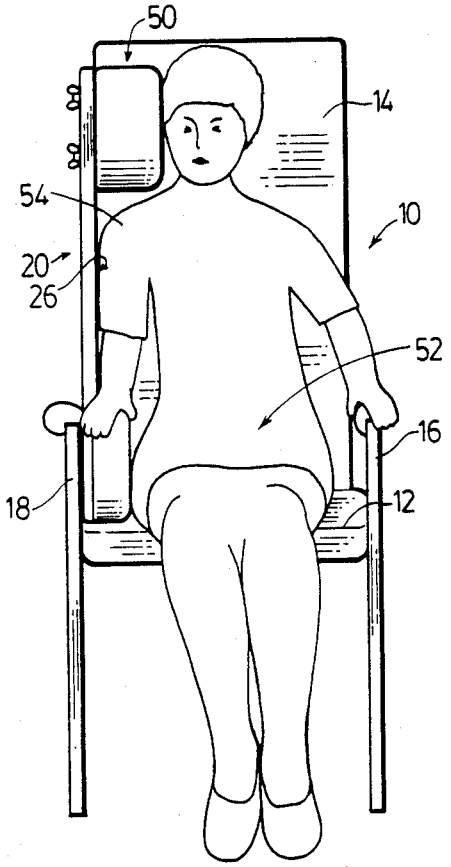
FIG. 1 is a front elevation view of a chair having the shoulder support apparatus of this invention attached thereto.
Figure 2:
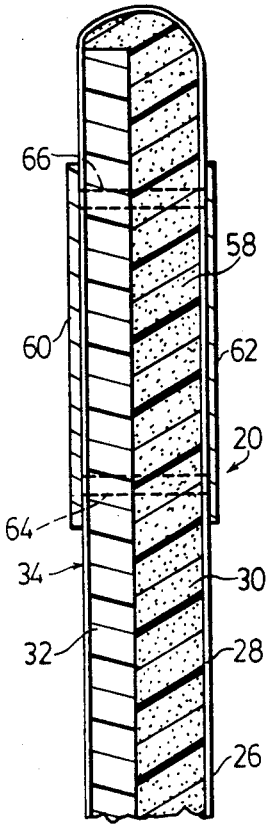
FIG. 2 is a section along the lines 2—2 of FIG. 3.
Figure 3:
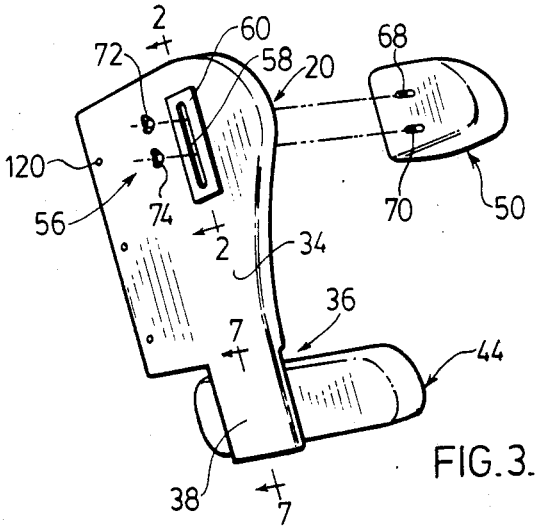
FIG. 3 is a perspective view from the side of the shoulder support of FIG. 1.
Figure 4:
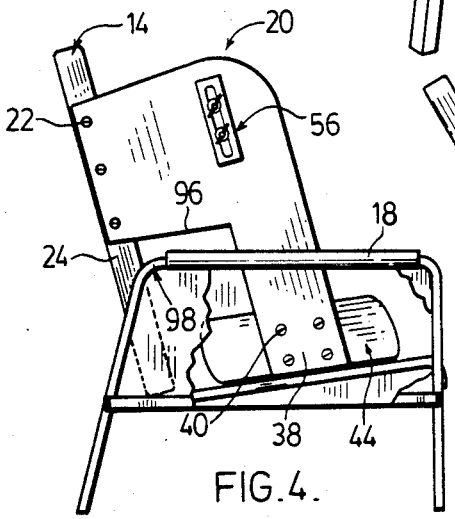
FIG. 4 is a side elevation of the shoulder support and chair of FIG. 1.
Figure 7:
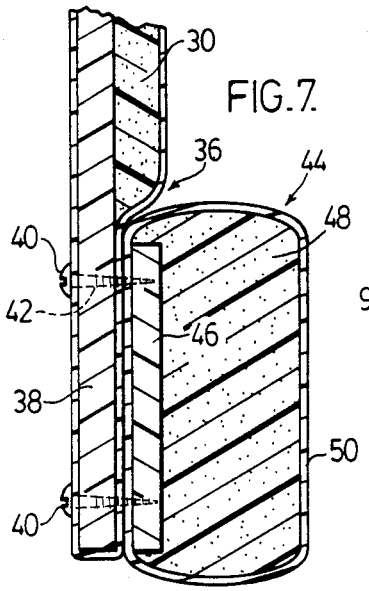
FIG. 7 is a section along the lines 7—7 of FIG. 3.

The shoulder support arrangement, according to a preferred aspect of this invention, may be adapted to fit the standard form of geriatric recliner chair. As shown in FIG. 1, the chair 10 has a seat 12, a back 14 and opposing side arms 16 and 18. The shoulder support is secured to the back 14 of the chair 10 in the manner as shown in FIG. 4, where the shoulder support 20 has bolts 22 extending therethrough and connected to the frame of the back 14. The shoulder support 20, as shown in FIGS. 1 and 4, extends downwardly of the side 24 of the back and on the inside of the side arm 18. The shoulder support has an inner surface 26 covered with a washable material 28, as shown in FIG. 2. The padding 30 for the shoulder support 20 is affixed to rigid plate 32 of the shoulder support. According to a preferred embodiment of this invention, the rigid plate may be ⅜ or ½ inch plywood; however, it is understood that metal or fiberglass plating and other similar materials may be used. The waterproof and washable covering 28 also extends along the plywood side of the shoulder support to totally encompass the shoulder support with the washable material to provide a pleasing appearance and ease in clean up. The plywood section 32 extends throughout the outer surface 34 of the shoulder support, as shown in FIG. 3. At the lower portion generally designated 36 of the shoulder support, the padding is absent to provide a downwardly extending rigid plate portion 38. This is shown in FIG. 7 where the padding 30 terminates in the region 36. Screws 40 extend through apertures 42 in the plywood to connect a hip bolster 44 to the lower portion 38 of the shoulder support. The screws are embedded in a plywood core 46 of the hip bolster to which foam 48 is attached and covered by waterproof covering 50.

Figure 9:
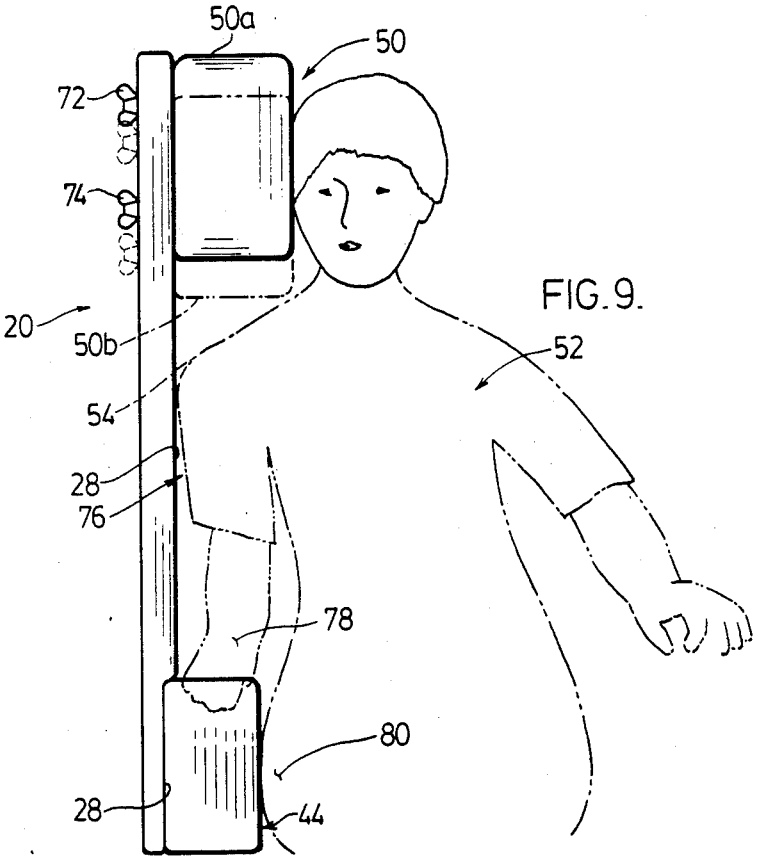
FIG. 9 is a front elevation of the shoulder support of FIG. 1 demonstrating the height adjustability of the headrest relative to the hip bolster.

As shown in FIG. 3, a headrest 50 is detachably secured to the shoulder support 20. The purpose of the headrest 50, as it overlaps a portion of the back 14, is as shown in FIG. 1 to encourage proper head orientation when the individual 52 is seated on the chair 10. The individual's shoulder 54 is leaned against the shoulder support inner surface 26. The headrest 50 extends inwardly of the shoulder support to compensate for the distance between the person's shoulder side and the head. Means generally designated 56 is provided to allow vertical adjustability of the headrest 50. Means 56 consists of a slot 58 as shown in FIG. 2 provided in the shoulder support 20. Two opposing plates 60 and 62 are mounted on the two sides 26 and 34 and are spaced apart by spacers 64 and 66 to avoid compression of the foam 30. Secured to headrest 50 are two bolts 68 and 70 which extend through the slot 58. Wing nuts 72 and 74 are tightened onto the bolts to position the headrest where desired, by way of a clamping action. The length of the slot 58 is greater than the spacing between the bolts 68 and 70 of the headrest to permit upward and downward movement of the headrest in the manner shown in FIG. 9. This provides for adjustability in the height of the headrest as determined by the height of the individual 52 and their posture while seated in the chair. Some individuals tend to slump more than others so that a raising or lowering of the headrest 50 is required. As shown in FIG. 9, the upper extent of the headrest is shown in solid line at **50*a* and as secured in that position by a tightening of the wing nuts 72 and 74. The lower position of the headrest is shown at 50*b* to accommodate either a shorter or slouching person in the chair. The headrest also, as discussed with respect to FIG. 1, encourages proper posture with the shoulder 54 leaning against the inner surface 28 of the shoulder support. The hip bolster 44 is positioned to define a recessed area generally designated 76 to receive the shoulder 54 and the arm 78. Where the individual has no muscular control over the arm, the defined recessed area 76 permits positioning of the arm in this area without pinching or jamming it between the person's body and the shoulder support 20. The arm may be simply laid in the recessed area on top of the hip bolster 44, because the hip bolster spaces the hip area 80 from the interior surface 28 to the extent shown in FIG. 9. This provides the multiple purpose of proper back posture and the spacing for the arm 78**.

Figure 8:
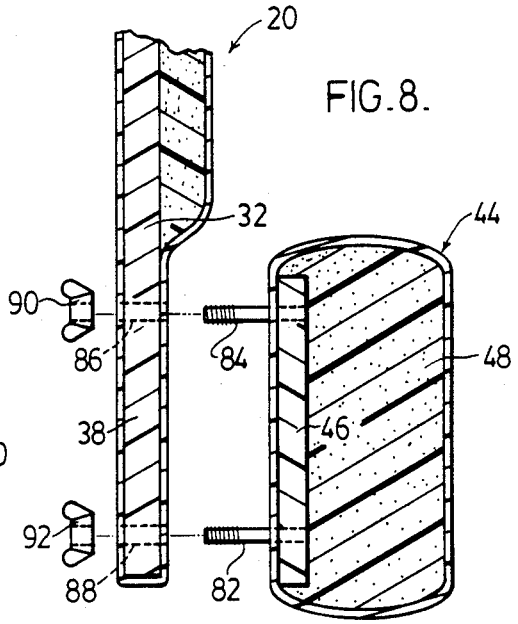
FIG. 8 shows an alternative embodiment for mounting the hip bolster of FIG. 7 to the shoulder support body portion.

An alternative embodiment for the hip bolster 44 is shown in FIG. 8 where bolts 82 and 84 are secured to the plywood core 46 of the hip bolster. The plywood 32 of the shoulder support 20 has apertures 86 and 88 formed therein through which the bolts extend. Wing nuts 90 and 92 are used to secure the hip bolster 44 to the depending portion 38 of the shoulder support. This permits detachable mounting of the hip bolster to provide for its selective use depending upon the physical disability of the person using the chair. In some situations, it may not be desirable to use the hip bolster because of the way the individual leans or the size of the individual.

Figure 5:
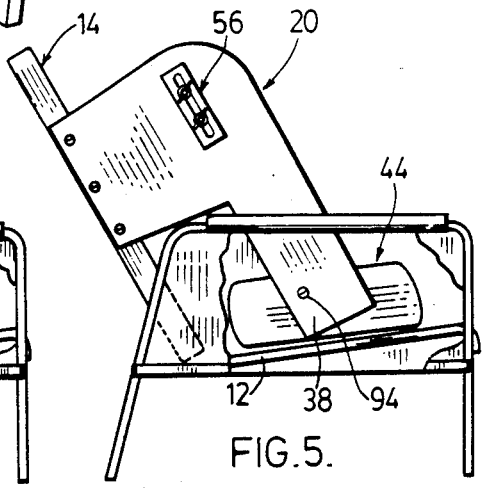
FIG. 5 is a side elevation of the shoulder support and chair of FIG. 1 in the reclined position.

In situations where the shoulder support arrangement 20 is used with a reclining chair, such as shown in FIG. 5, where the back 14 reclines relative to the seat 12, it may be desirable to pivotally mount the hip bolster 44 to the depending portion 38 of the shoulder support. This can be accomplished by a single bolt 94 extending through the plywood 38 and the plywood core 46 of the hip bolster. This allows the hip bolster 44 to continue to assume the angle of the seat 12 when the back 14 is tilted. The headrest 50, although not shown in section, may be constructed in the same manner as hip bolster 44 having an inner plywood core to which the bolts, as shown in FIG. 3, are secured and foam padding with surrounding waterproof material enclosing the headrest.

Figure 6:
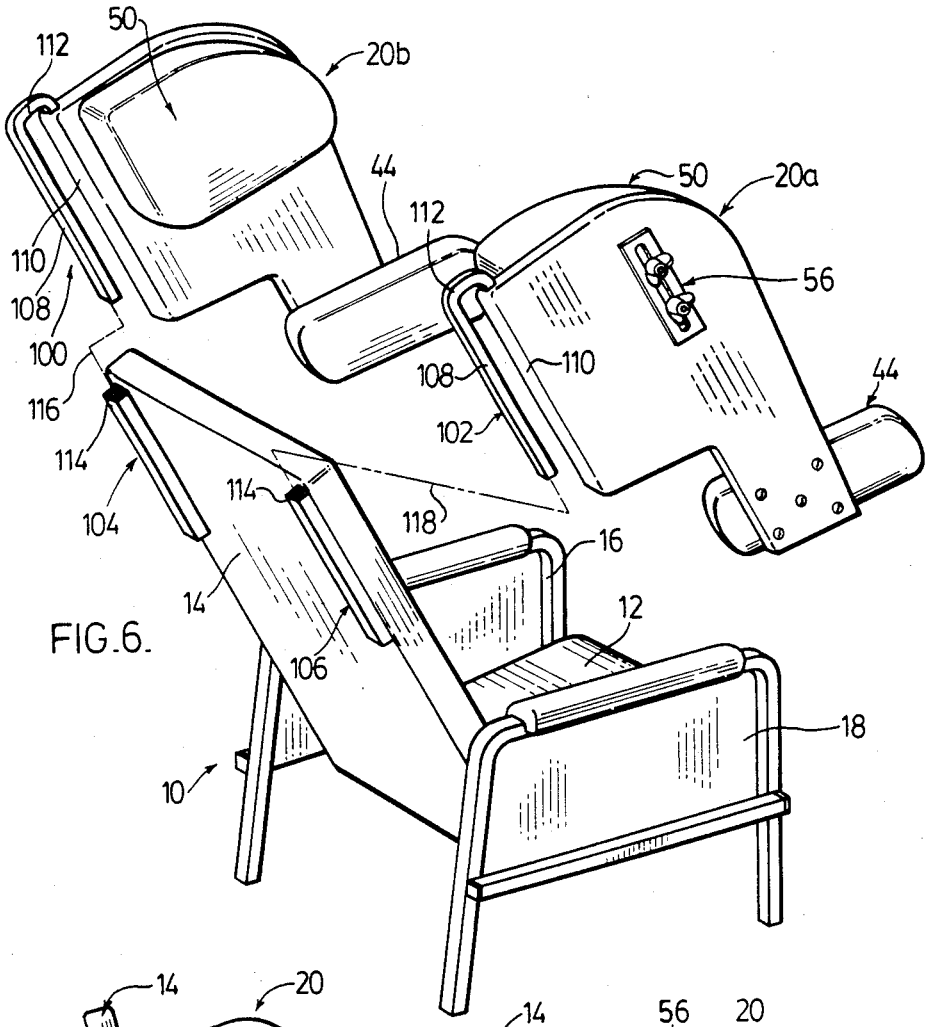
FIG. 6 is a perspective view of a chair having a pair of shoulder supports detachably mountable on the chair back.

The shoulder support 20, as shown in FIG. 4, is generally L-shaped and when mounted on the chair back 14 is in the shape of an inverted "L" having the depending leg portion with the larger body portion secured to the chair back. The lower edge 96 of the enlarged portion of the shoulder support is spaced sufficiently above the side arm 18 to provide an opening in the area generally designated 98. This opening is on both sides of the chair, should two shoulder supports be mounted on the chair in the manner shown in FIG. 6. This opening permits the use of a tie for purposes of holding the individual seated in the chair. This form of shoulder support avoids strapping the person in the chair. However in some situations, it may be still necessary to provide some restraint about the waist of the individual in holding the person in the chair, while encouraging the person to use their muscles to maintain a vertical attitude as they rest against the shoulder support.

In situations where the handicapped person may lean to either the left or right hand sides of the chair, according to another embodiment of the invention, shoulder supports 100 and 102 are mounted to each side of the chair back 14. The difficulty, however, in having the shoulder supports **20*a* and 20*b* on each side of the chair is that the attendant encounters difficulty in lifting the individual into and from the chair. To overcome this problem, the shoulder supports 20***a* and 20*b* are provided with means 100 and 102 which interact with corresponding coupling devices 104 and 106 mounted to the frame of the chair back 14. According to a preferred embodiment of the invention, the detachable coupling devices 100 and 102 each consists of a rod 108 which extends along the rear portion 110 of each shoulder support. The rod is curved at 112 and according to this embodiment, extends down the rear portion of the shoulder support and by fasteners (not shown) is secured to the plywood core of each shoulder support. The rod 108 of each connector 100 and 102 is inserted in the corresponding tubular sockets 114 of the corresponding coupling devices 104 and 106. In order to maintain the positioning of the shoulder support as extending outwardly from the back generally in the direction of the respective arms 16 and 18, a non-swivel connection is provided. This is accomplished by providing an irregular shaped in cross-section rod to be correspondingly received by the tubular shape of the socket 114. According to this embodiment, the rod 108 is rectangular in cross-section to fit in a correspondingly rectangular shaped socket 114. Thus both shoulder supports may be positioned on the chair 10 by inserting the respective rods 108 into the scokets 114 along the paths generally indicated by lines 116 and 118. The patient can be seated in the chair and leaned to either side where the hip bolsters and headrests to each side encourage correct posture, as discussed with respect to FIGS. 1 and 9. The hip bolster may be optionally attached to the shoulder support in the manner shown in FIG. 8. When it is desired to remove the person from the chair, the shoulder support can be removed from either side as desired by the attendant to permit the attendant to reach in and lift the person into or from the chair.

It is appreciated that many other types of detachable connections may be provided in attaching the shoulder support to the back of the chair. For example, instead of the bolts 22 used in permanently securing the shoulder support arrangement to the chair back, wing nuts could be used to engage bolts which extend out of the chair back frame and through apertures 120, as shown in FIG. 3, which would extend through the padding and plywood core of the respective shoulder support. The wing nuts would be threaded onto the projecting bolt portions to releasably connect the shoulder supports to the respective sides of the chair back.

The plywood or fiberglass core, as used in the shoulder support, the hip bolster and the headrest, is of sufficient thickness to resist in some cases the considerable forces exerted laterally on the supports during use. The shoulder support system only supports the patient where needed and no support where not needed so as to develop or enhance the patient's use of the muscles in sitting upright and thereby prevents further deterioration of the muscles. By not strapping the individual in the chair and encouraging use of their muscles to sit upright, there is less chance of skin break down. Thus, the system, according to this invention, provides a system of supporting the individual in the chair rather than a system of restraining the person in the chair. With the use of the headrest, it prevents muscles in the neck of the individual tightening up as would be caused by the head tilting against the shoulder support in the absence of the headrest. In situations where the person's head tends to fall forward, the chair can be reclined in the manner shown in FIG. 5 to correct this problem. As discussed with respect to FIG. 6, the outward extending orientation of the shoulder support must be maintained. With the embodiment of FIG. 1, this is accomplished by the depending portion 36 of the rigid support of the shoulder arrangement extending within the respective arm. When weight is applied to the shoulder support, the depending portion abuts the side arm to prevent further outward swinging of the shoulder support. It is appreciated that other devices may be incorporated to overcome this problem and provide means to prevent outward swinging of the shoulder support when weight is applied thereto by the person sitting in the chair.

The shoulder support arrangement, according to this invention, can be provided in right and/or left sided attachments to the chair with or without the hip bolsters. Optionally the arrangement can also be provided permanently on the chair, particularly if it is only needed on the side of the chair. The system is padded and completely upholstered with no sharp corners or rough areas. The system may be covered with washable and cleanable vinyl commonly found in the marketplace with standard foam materials used as padding.

The system promotes even shoulder levels and keeps the head vertical preventing a kinked neck when the height is properly adjusted. The system gives the patient a normal visual perspective of the world, rather than seeing it from a sloped position as is common in the case of existing chairs. This increases the patient's chances for social interaction. Also the chair positions the individual so that they can be more readily fed. In promoting proper posture, easier breathing is achieved for the person and reduces the chance of congestion due to the inability to cough when the person using a chair without the shoulder support is slumped over.

Although various preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A chair comprising a seat, a back and opposing side arms, a shoulder support connected to a side of said back and extending outwardly of said back in the general direction of a corresponding side arm, a headrest mounted on said shoulder support and overlapping a portion of said back, means for mounting said headrest on said shoulder support to provide for vertical height adjustment of said headrest relative to said seat to accommodate varying shoulder heights of persons using said chair, said shoulder support having a rigid plate which extends downwardly and contacts an inner portion of said side arm, said rigid plate contacting said side arm to provide said means for maintaining said shoulder support in a shoulder supporting position, means for detachably connecting said shoulder support to said back, a hip bolster being provided along said side arm and said seat to space a person's hip from said side arm, a recessed area being defined below said headrest along said shoulder support and above said hip bolster to receive and support a shoulder of a person on said chair.

2. A chair of claim 1 wherein each side of said chair has said shoulder support detachably connected thereto.

3. A chair of claim 1, wherein said hip bolster is connected to said rigid plate.

4. A chair of claim 1, wherein said shoulder support extends from an upper portion of said back down to at least said side arm, said shoulder support having padding extending from its upper portion down to proximate said side arm.

5. A chair of claim 4, wherein said padding is affixed to a rigid plate of said shoulder support, said rigid plate extends below said side arm, a hip bolster being connected to said rigid plate which extends below said side arm.

6. A chair of claim 5, wherein the position of said rigid plate which extends below said side arm is spaced from said back and spaced above said side arm to provide an opening through said shoulder support above said side arm.

7. A chair of claim 6, wherein said rigid plate is generally L-shaped and mounted to said back in an inverted manner.

8. A chair of claim 5, 6 or 7, wherein said shoulder support, hip bolster and headrest are covered with a washable, water impermeable material.

9. A chair of claim 1, wherein said means for detachably connecting said shoulder support comprises a rigid rod secured to said shoulder support and spaced from and extending along a rear portion of said shoulder support, said rod being irregular in cross-section, a tubular socket being secured to a rear portion of said back into which said rod may be slid, said socket having its hollow interior of a cross-section corresponding to that of said rod, said socket being oriented to receive said rod in a manner to form said means for maintaining said shoulder support in a shoulder supporting position.

10. A chair of claim 9, wherein said side of said back has said shoulder support detachably connected thereto.

11. A chair of claim 1, wherein said mounting means for said headrest comprises an elongate slot formed in said shoulder support, said shoulder support having a rigid plate with padding and covering material affixed thereto, said slot extending through said covering, padding and rigid support, said headrest having means projecting from an inner face thereof which extends through said slot, said projecting means stabilizing said headrest in extending through said slot, said projecting means having distal end to which means is connected for clamping said headrest to said shoulder support at a desired vertical height adjustment, said slot having a length dimension which determines the extent of said desired vertical height adjustment.

* * * * *